United States Patent [19]

Inokawa et al.

[11] Patent Number: 4,545,292

[45] Date of Patent: Oct. 8, 1985

[54] ROOF RIDGE VENTILATION APPARATUS

[75] Inventors: Michio Inokawa, Ichikawa; Minoru Watanabe, Yamato; Yoshiteru Miyasaka; Toshio Watanabe, both of Nihonbashi, all of Japan

[73] Assignees: Tokyo Land Corporation; Nippon Light Metal Co., Ltd.; Shin Nikkei Company, Ltd., all of Tokyo, Japan

[21] Appl. No.: 482,495

[22] Filed: Apr. 6, 1983

[30] Foreign Application Priority Data

Apr. 22, 1982 [JP] Japan ..... 57-59340[U]

[51] Int. Cl.[4] ..... F24F 7/02

[52] U.S. Cl. ..... 98/42.21; 277/184

[58] Field of Search ..... 98/42 A, 83; 277/182, 277/183, 184

[56] References Cited

U.S. PATENT DOCUMENTS

| | | | |
|---|---|---|---|
| 2,218,926 | 10/1940 | Teichmann | 98/42 A |
| 2,404,961 | 6/1946 | Hoch | 98/42 A |
| 2,711,919 | 6/1955 | Moskovitz | 277/32 |
| 2,799,214 | 7/1957 | Roose | 98/42 A |
| 3,481,263 | 12/1969 | Belden | 98/42 A |
| 4,073,106 | 2/1978 | Malott | 98/42 A X |

FOREIGN PATENT DOCUMENTS

| | | | |
|---|---|---|---|
| 57-52734 | 3/1982 | Japan | 98/42 A |
| 119737 | 10/1918 | United Kingdom | 98/42 A |

*Primary Examiner*—William E. Wayner

*Attorney, Agent, or Firm*—Watson, Cole, Grindle & Watson

[57] ABSTRACT

A novel ridge ventilation apparatus for a roof provided with ridge tiles at a ridge, comprises at least one air duct provided above a rafter, and at least one ventilator provided in lieu of several ridge tiles and is shaped substantially identical to that of the ridge tiles, and ends of the top frame are fixed to ends of the ridge tiles. Since the appearance of the ridge ventilators are substantially the same as that of the roof ridge, no unusual impression is aroused as has been so for a conventional roof in which ventilators project above the roof ridges.

17 Claims, 10 Drawing Figures

ROOF RIDGE VENTILATION APPARATUS

FIELD OF THE INVENTION

This invention relates to a ridge ventilation apparatus in a roof. More particularly, the invention relates to an improvement in a ridge ventilation apparatus to which an air duct which is provided in the roof ridge is connected, i.e., so as to ventilate the air space below the roof.

BACKGROUND OF THE INVENTION

Ridge ventilation apparatuses conventionally used, generally include a structure in which ridge ventilators are projected above ridge tiles. Therefore, since the ventilators are formed separately above ridge tiles, their shape does not match that of the roof. In addition, since end caps are necessary for enclosing the ends of the ventilators, and since it is not easy to shape the form of the caps so as to correspond exactly to that of the ventilator's end, there often occurs a situation in which the caps do not seal the ventilators sufficiently.

BRIEF DESCRIPTION OF THE INVENTION

The principal object of the present invention is to provide an improved ridge ventilation apparatus which overcomes the drawbacks mentioned above. Other objects of the invention will be clear from the description hereinafter.

According to the invention, there is provided a ridge ventilation apparatus for a roof provided with ridge tiles at the ridge, characterized in that it comprises one or more of an air duct provided above a rafter, and one or more of a ridge ventilator connection to the air duct, which are provided in lieu of several ridge tiles, and that the top frame of the ventilators being shaped substantially identical to that of the ridge tiles, and ends of the top frame being fixed to the ends of the ridge tiles.

The top frame is fixed to the ridge tiles in such a manner that, when round ridge tiles having a collar are used, the end margins of the top frame are fitted under the collar, while when channel tiles are used, ends of the tiles and the frame are faced to each other. In the latter case, a water-drip plate is provided below the part where the frame and the tiles are fixed to each other.

DESCRIPTION OF THE PREFERRED EMBODIMENTS

Figure 1:
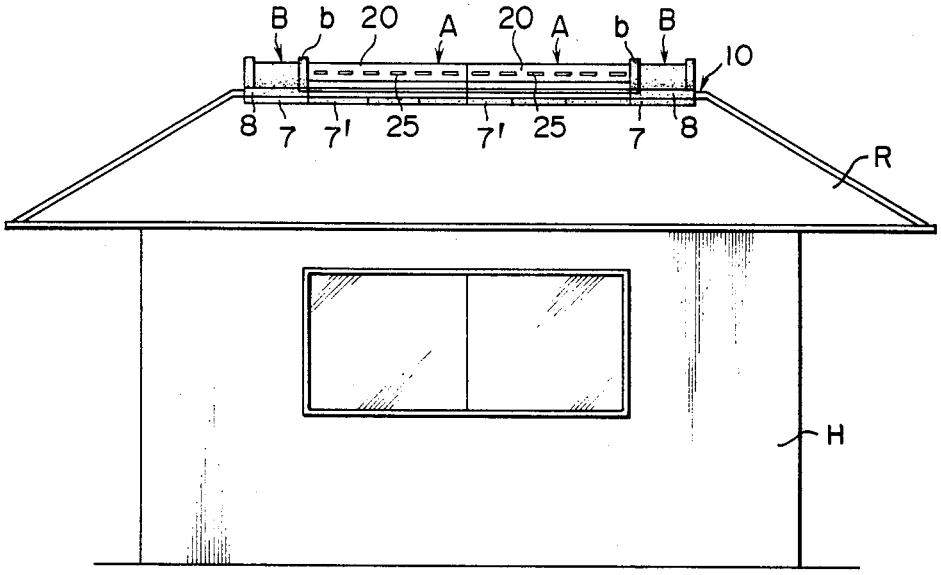
FIG. 1 is a side view of a house having a roof ridge which is provided with the ventilator apparatus together with round ridge tiles according to the invention.
Figure 2:
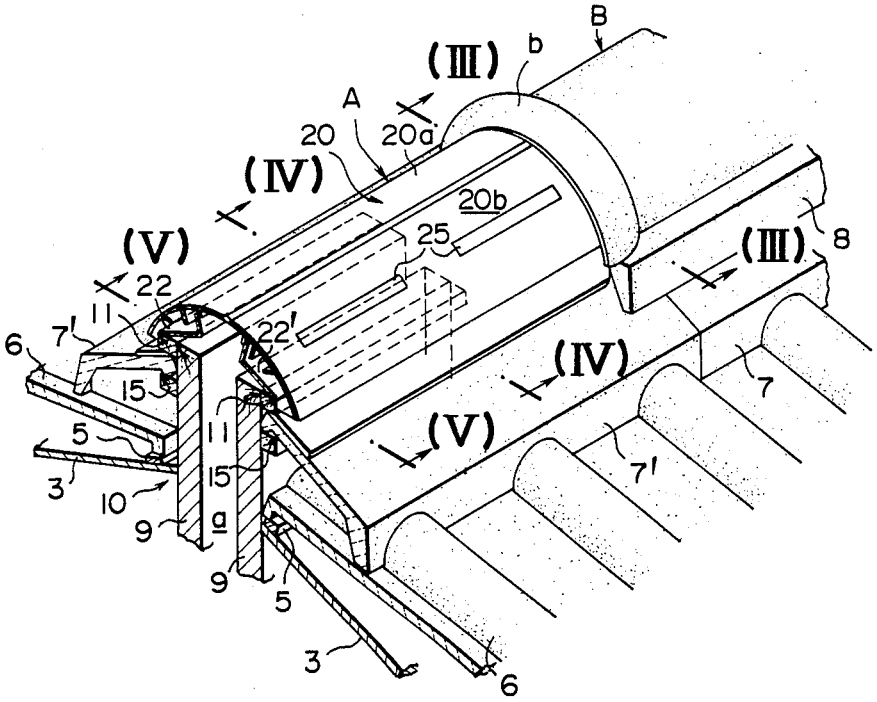
FIG. 2 is a perspective view, partially in section, of the FIG. 1 center part of a roof ridge.
Figure 3:
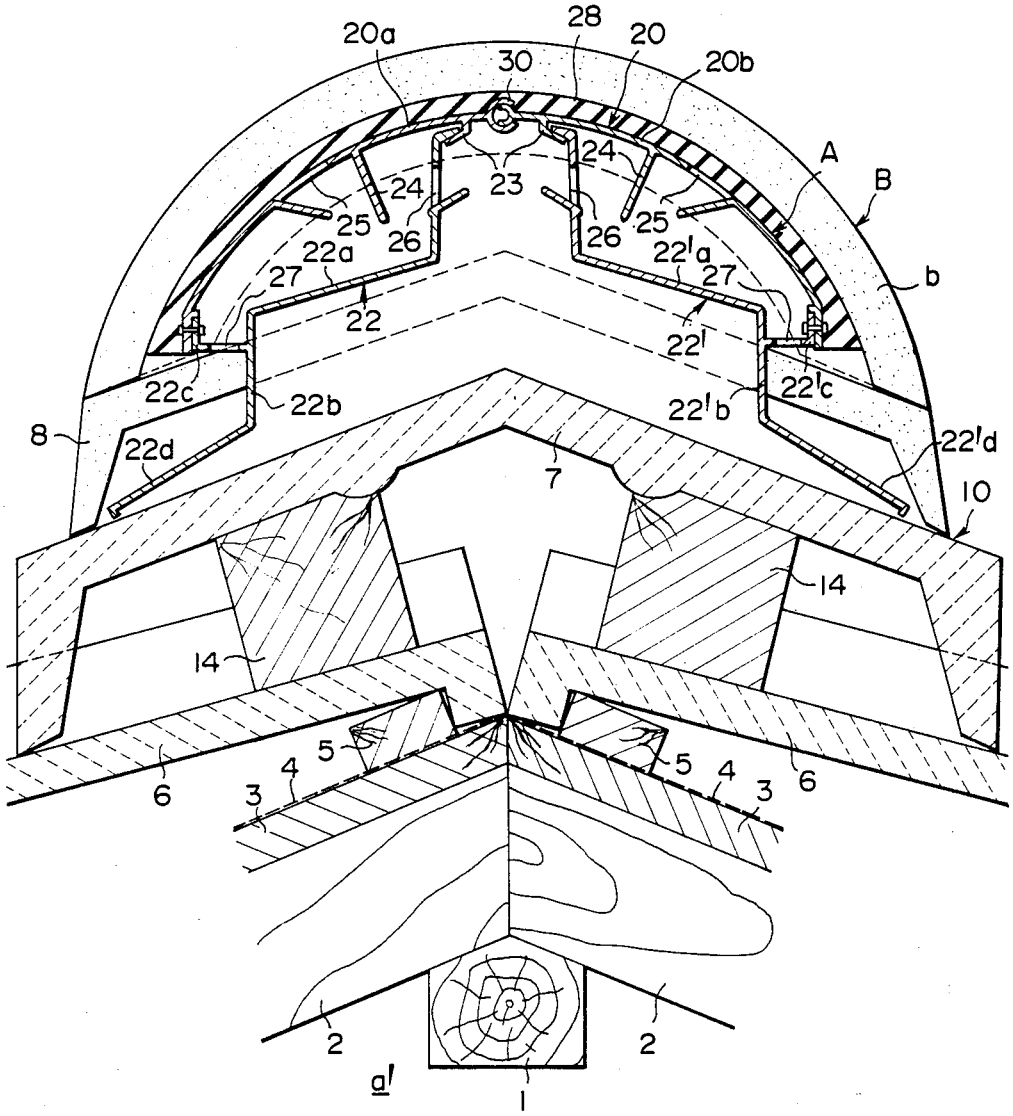
FIG. 3 is a sectional view along the line (III)—(III) of FIG. 2.
Figure 4:
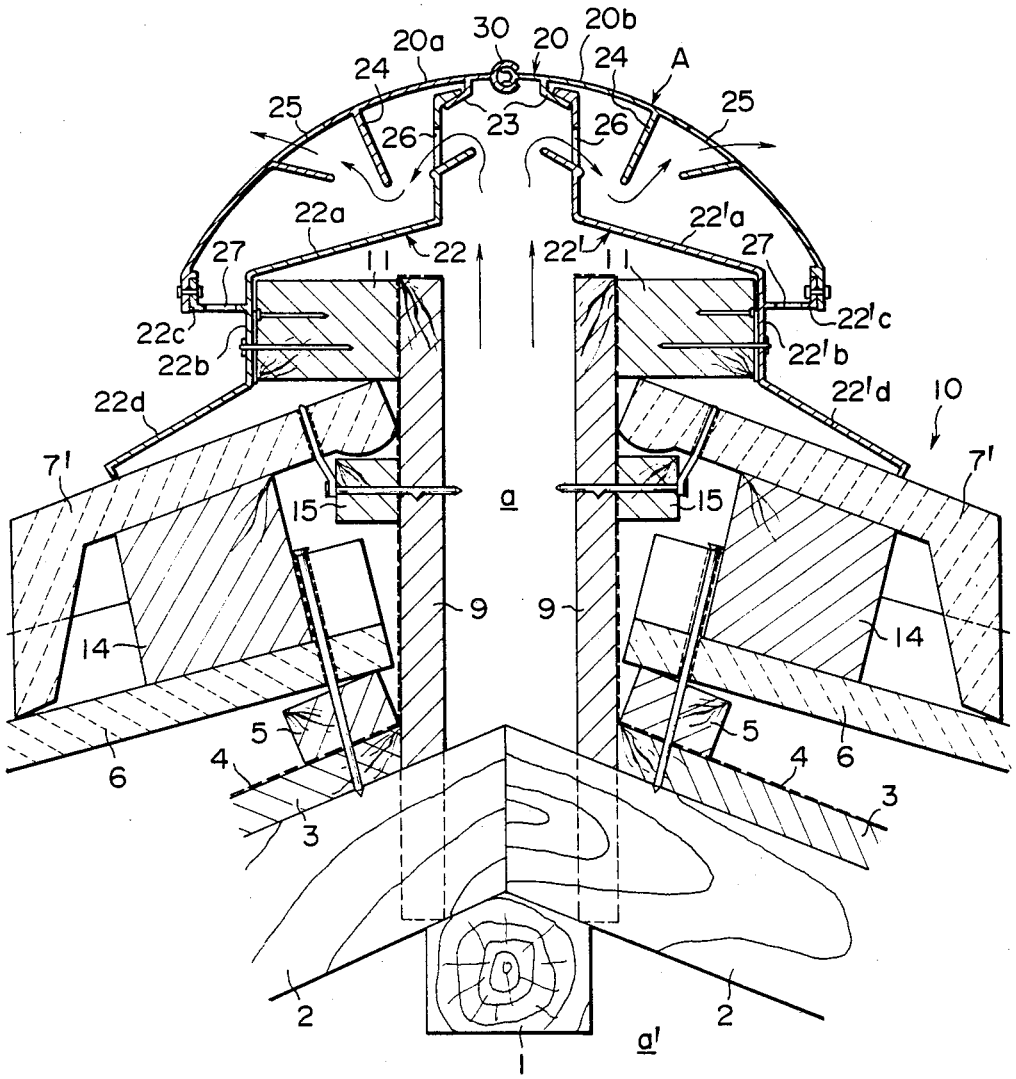
FIG. 4 is a sectional view along the line (IV)—(IV) of FIG. 2.
Figure 5:
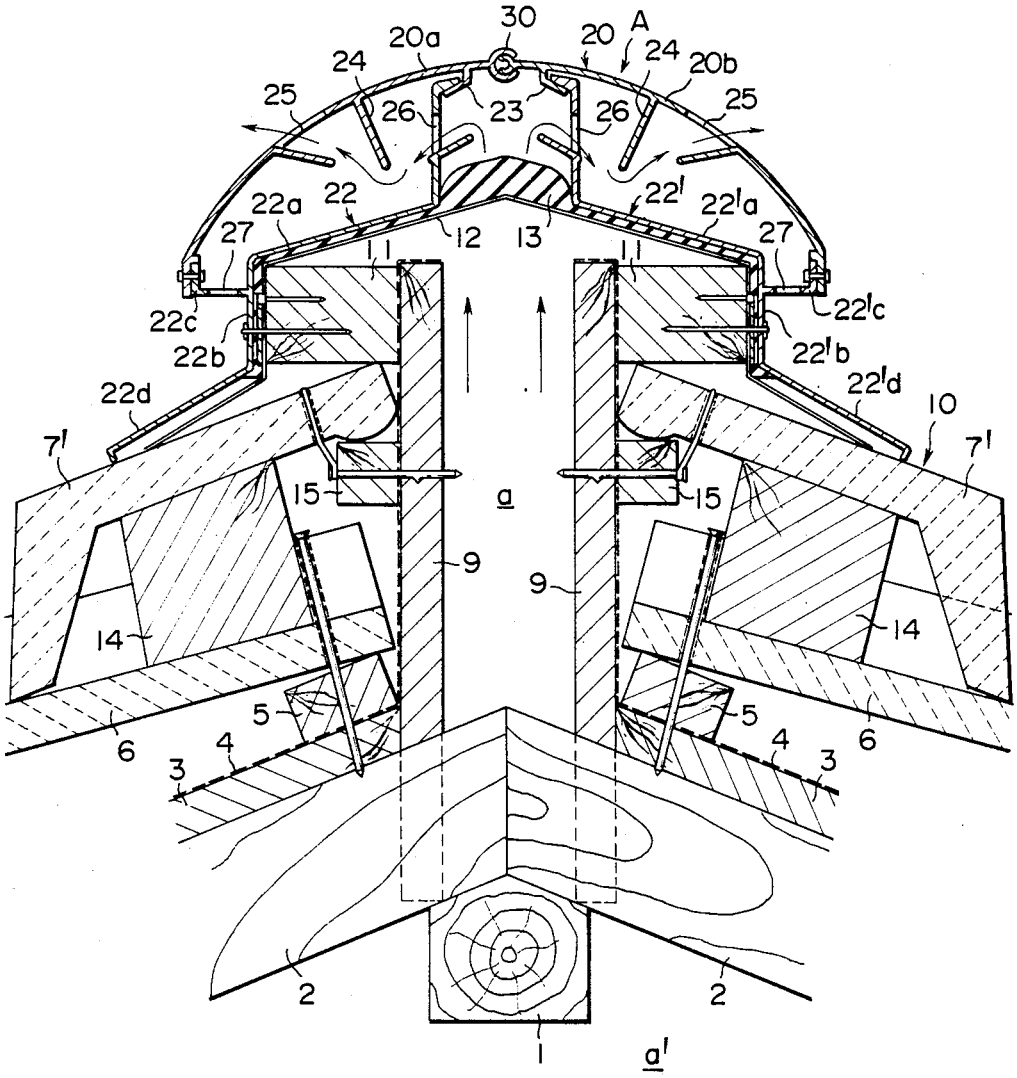
FIG. 5 is a sectional view along the line (V)—(V) of FIG. 2.

In FIG. 1, reference A is a ridge ventilator and reference B is a round ridge tile at the top of a roof R of a house H. As shown in FIGS. 3 through 5, the roof ridge 10 of the roof R includes a pair of rafers 2 which extend upwardly to a horizontal ridge piece 1, the rafters 2 being covered by battens 3 and then a waterproof sheet 4, such as a roofing cover.

Above the waterproof sheet 4 are placed a pair of foreign type roof tiles 6, and a noshi (standard) tile 7. At the part where the round ridge tile B is used, a noshi (straight foot) tile 8 is placed on the noshi (standard) tile 7. The round ridge tile B is provided on the noshi (straight foot) tile B (FIG. 3).

As shown in FIGS. 4 and 5, at the part where the ridge ventilator A is set, the noshi (straight foot) tile 8 is not used, and separated noshi (standard) tiles 7, 7' are used. Vertical members 9, 9 are provided upright on the rafters 2, 2, between the right and left noshi (standard) tiles 7, 7'.

The vertical members 9, 9 define an air duct a which communicated with roof truss a'.

Top rails 11, 11 are adhered to the outer surface of the upper part of the vertical members 9, 9, so that the ridge ventilator A can be fixed to the top rails by means of nails or the like.

In another embodiment (not shown), it is possible to place top rails having a rectangular cross section above the batten in a manner that the air duct a which communicates with the roof truss a', is formed between the top rails, the ridge ventilator A being attached to the top surface of the top rails by means of nails and the like.

The round ridge tile B has a substantially semi-circular cross section and is provided with at one end with an integral semi-circular collar b. Two ends of the tile B are opened if the tile is placed at an intermediate position, while if it is placed at a ridge end as shown in FIG. 1, one end is sealed by means of an end cap or the like.

The ridge ventilator A is provided between two round ridge tiles B and above the top rails 11, 11 in such a manner that an air duct a is positioned below the ventilator A.

The embodiment of FIG. 1 has a structure provided with two ridge ventilators A, A. However, it is possible to increase the number of the ridge ventilators or that of the round ridge tiles B.

The ridge ventilator A comprises a top frame 20 and a pair of lower frames 22, 22' of symmetrical structure. The top section 20 comprises a left frame **20*a* and a right section 20*b*. These sections are pivotally interconnected by a hinge 30 to form a semi-circular shape of a size substantially identical to that of the round ridge tile B. The left and right sections 20*a*, 20*b*, each of which has respective hook 23 and an intervening plate 24**, can be produced by an extruding process.

Lower frames 22, 22', which are produced also by an extrusion process, respectively comprise an inner wall **22*a*, 22'*a*, a fixing part 22*b*, 22'*b*, a connecting part 22*c*, 22'*c* and a skirt 22*d*, 22'*d*. The top end of the inner wall 22*a*, 22'*a* is fixed to the hook 23, 23 of the top frame 20, while the connecting part 22*c*, 22'*c* is connected to the inside of the lower end of the top frame 20 so that the lower frame 22, 22' is firmly fixed to the top frame 20. The fixing part 22*b*, 22'*b*** is vertically disposed while the skirt 22*d*, 22'*d* is downwardly and outwardly inclined out.

Figure 6:
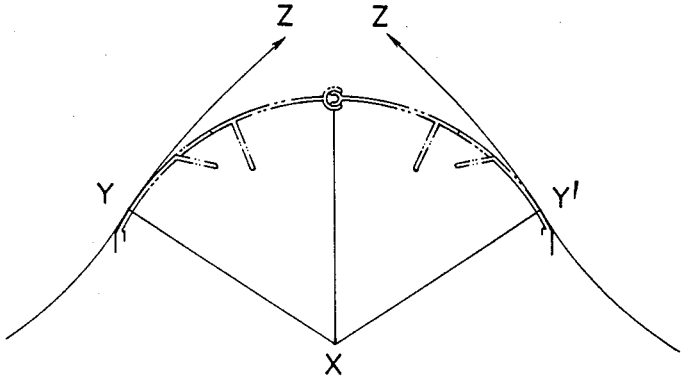
FIG. 6 is a frontal view illustrating the best position of exhaust ports in the ridge ventilator.

The top frame 20 is provided with spaced exhaust ports 25. The lower frames 22, 22 are provided with respective exhaust ports 26 in their inner walls 22*a*, 22'*a*, and a water port 27 in their connecting parts 22*c*, 22'*c*. The exhaust port 25 is provided preferably at a position between X–Y and X–Y' in FIG. 6.

The ridge ventilator A extends over two top rails 11, 11 and is fixed to the rails along the fixing parts 22*b*, 22'*b* by means of nails or the like (FIG. 4).

At a point where two ventilators A, A are connected, a back board 12 is provided above right and left noshi (standard) tiles 7, 7' so that the lower frames 22, 22' of respective ventilators A, A, are placed on the back board (FIG. 5). In this instance, it is preferred to place sealing materials 13, 13 on the back board 12, in order that the board may be water-tight.

The end of the ridge ventilator A is fitted under a collar b of the round ridge tile B via a sealing material 28 in a manner that the top frame 20 may be fitted inside the collar b (FIG. 3). In the drawings, a reference 14 indicates mortar and a reference 15 represents a cross-piece for the noshi (standard) tile 7'.

Each of the ridge ventilators A having an appearance similar to that of round ridge tile B is set between tiles B on the roof ridge, and functions to exhaust air in the roof truss a' through the air duct a and exhaust ports 26, 25 of the ventilator A to the outside, for ventilation.

The ridge ventilator A having the structure mentioned above, functions as follows:

1. Since its top frame 20 is semi-circular in form, air flows toward the ventilator A flows by a direction as shown in the arrow Z in FIG. 6. Therefore, negative pressure zone (−) is formed at the area within 50 degrees from the line along the center X and the top. Consequently, since the exhaust port 25 is provided in the negative area shown in X—Y and X—Y', air is effectively drawn out due to aspiration action even under strong wind.

2. The left and right sections 20*a*, 20*b* are pivotally mounted by means of a hinge 30. Therefore, the ridge ventilator A can be adjustably fixed depending on the inclined angle of the roof or on the diameter of the ridge tiles.

3. Since the fixing parts 22*a*, 22*a*' of the lower frames 22, 22' are formed upright and since the top frame 20 is provided with intervening plates 24, 24, wind or rain water entering through water outlets 27, 27 are led to the exhaust ports 25. In this way, return of the rain water from the water outlet 27, or the penetration of water into the air duct a from the exhaust port 26, is prevented.

4. The intervening plate 24 leads rain water, which may enter from the exhaust port 25, to the water outlet 27, and thus acts to prevent the water from flowing into the port 26. Further, since the exhaust ports 25 are positioned lower than the exhaust port 26, even if the water outlets 27 are stopped and if rain water stays, the water can be drained from the port 26 to the outside.

In addition, since the ends of the ridge ventilator A are fitted tightly under the collar b, rain water is prevented from entering inside, while a plurality of the ridge ventilators are connected sealingly by means of a back board 12.

Figure 7:
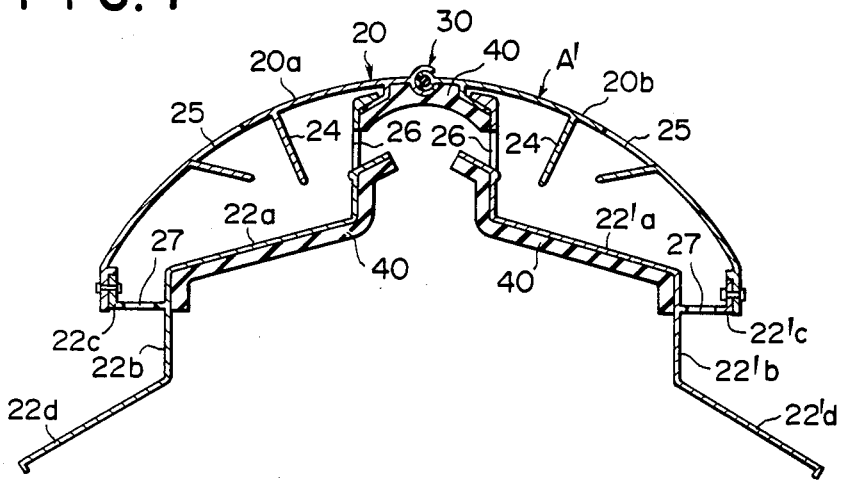
FIG. 7 is a sectional view of a varied embodiment of the ridge ventilator.
Figure 8:
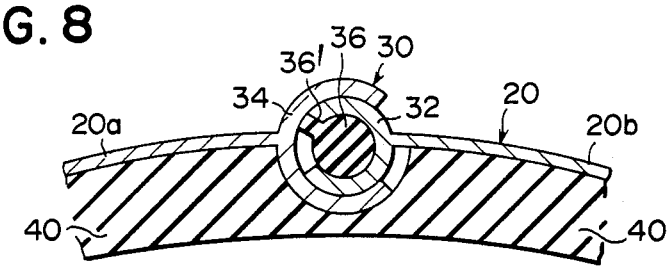
FIG. 8 is an enlarged view of a part shown in FIG. 7.

FIGS. 7 and 8 illustrate, respectively, a varied embodiment of the ridge ventilator in which the ventilator A' is provided with a heat-insulating layer 40 at least at the surface facing air duct a. The layer 40 consists sheet material having a good heat-insulating property such as rock wool, glass wool, asbestos or foamed styrol resin, which is adhered to the inside of the ventilator A'. Alternatively, heat-insulating material is mixed with adhesive and is sprayed to a predetermined part of the inner surface of the ventilator.

The heat-insulating layer 40 can prevent the inner surface of the ventilator from being wetted with dew.

The hinge 30 of the top section 20 A' has an outer and inner cylinder 34, 32. The inner cylinder 32 is provided with bar-formed sealing material 36 having a projection 36'. The projection having been formed integrally with the bar 36, slidably contacts the outer cylinder 34 in an air-tight and a water-tight manner.

Due to the provision of the sealing material 36, the hinge 30 is made air-tight and water-tight.

Figure 9:
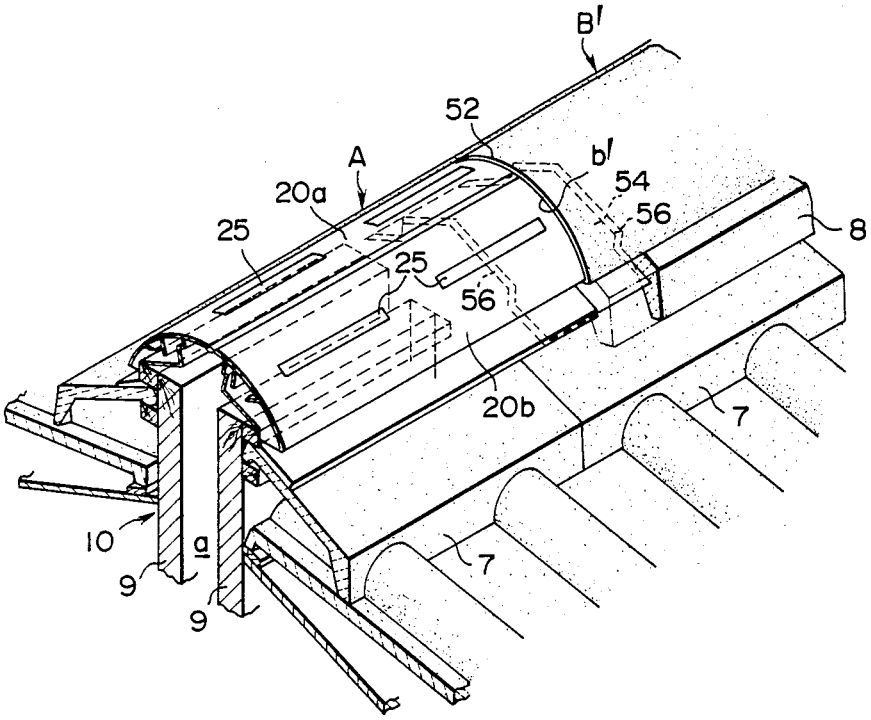
FIG. 9 is a perspective view, partially in section, of the ventilation apparatus set to a roof ridge which is provided with channel tiles.
Figure 10:
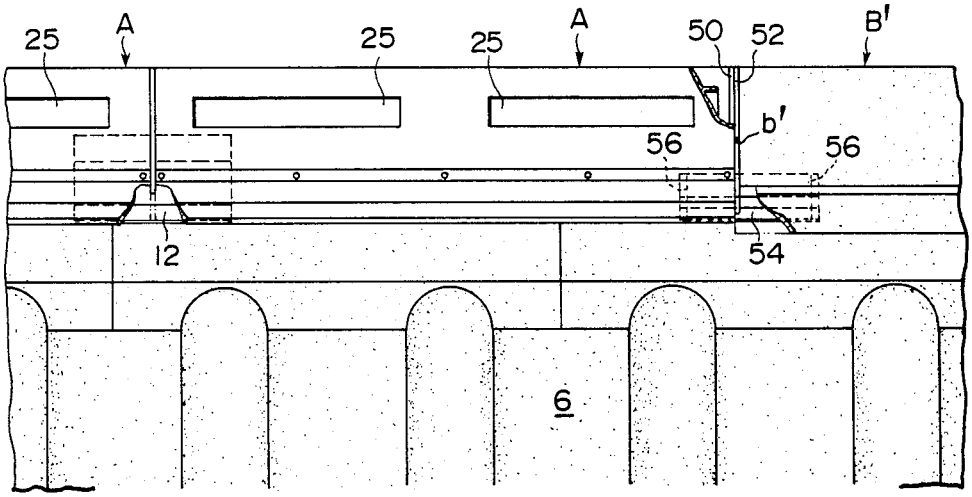
FIG. 10 is an enlarged side view, partially cut out, of the part shown in FIG. 9.

FIGS. 9 and 10 show a structure in which channel tiles B' are used instead of round ridge tiles having a collar, as the ridge tiles. For simplicity, an explanation is made only to the use of a ridge ventilator A.

Ends of the ridge ventilator A are closed by end caps 50 which seal the sides of a space formed between a top frame 20 and lower frames 22, 22'. The cap 50 faces the end b' of the channel tile B'. Sealing material 52 is provided between the cap 50 for the ventilator A and the end of the tile B'.

Below the part connecting the ridge ventilator A to the channel tile B', a water-drip plate 54 is provided on a noshi (straight foot) tile 8, in such manner that ends of the lower frame 22, 22' and the channel tile B' are placed on the water-drip plate 54, so as to retain the connecting part water-tight. In the drawings, a reference 56 indicates sealing material affixed to side surfaces of the water-drip plate 54.

The ventilator apparatus according to the invention can be applied not only to the tile roof explained hereinbefore, but also to a slated roof. Further, the ridge ventilator can be formed appropriately depending on the form of adjacent tiles and, thus it is not limited to semi-circular form.

According to the invention, the ridge ventilators are used in lieu of several ridge tiles in such a manner that the top frame of respective ventilators is shaped substantially same as that of the ridge tile. Therefore, ventilators can be shapely fitted to the ridge tiles and the sealability at the part where the ventilators are connected to the tiles, are not destroyed. In addition, the top frame is so formed to generate a negative pressure zone to the flowing direction of wind, which results in improving the ventilation effect.

Since the appearance of the ridge ventilators are substantially same as that of the roof ridge, no different or unusual impression is aroused as is the case with a conventional roof in which the ventilators project above the roof tiles. Thus, the appearance of the roof is enhanced.

We claim:

1. A ridge ventilation apparatus for use between spaced apart ridge tiles that are positioned over the ridge of a roof which has an upwardly directed air duct at its ridge for exhausting air from therebelow, said ridge tiles having identical exterior configurations, said ridge ventilation apparatus comprising an elongated top frame which has an upper surface and a lower surface, said upper surface being configured to substantially conform to the exterior configuration of said ridge tiles, said elongated top frame including a left half section and a right half section, each of said half sections including an upper end and an opposite lower end, the upper ends of said half sections being interconnected, each of said half sections including an exhaust port therein between its upper end and its lower end and a baffle plate which extends downwardly from its lower surface at a point between its upper end and its exhaust port, the lower end of said baffle plate extending downwardly to a point below the associated exhaust port, and elongated left and right lower frames which are respectively connected to the inner surfaces of said left and right half sections such that a spacing is left between said lower frames, each of said lower frames including an upper part which includes an exhaust opening therein, said exhaust opening being located above said lower end of the baffle extending downwardly from the associated half section of said top frame, and a lower part which includes a connecting portion which extends outwardly to contact the lower end of the associated half section of said top frame, said connecting portion including a drainage opening therein, said left and right lower frames and said left and right half sections forming therebetween respective left and right chambers, air from said air duct at the ridge of said roof being able to pass outwardly through said exhaust openings in the upper parts of said left and right lower frames and into said left and right chambers, around the baffle plates extending downwardly from the associated left and right half sections and out said exhaust ports, said baffle plates preventing water from passing inwardly through said exhaust openings.

2. A ridge ventilation apparatus according to claim 1, wherein said ridge tiles are channel tiles having no collars, and wherein said top frame has opposite ends which are fixed to ends of adjacent channel tiles.

3. The ridge ventilation apparatus as defined in claim 1, wherein the upper surface of said top frame is smooth, and when viewed in cross section, conforms to the periphery of a circle.

4. The ridge ventilation apparatus as defined in claim 3, wherein with respect to an imaginary radial line extending from the center of said circle through the connection point between the left and right half sections of said top frame, said exhaust ports are located in said half sections to be within a 50° area thereof.

5. The ridge ventilation apparatus as defined in claim 1, wherein the upper ends of said left and right half sections of said top frame are connected by pivot means to enable pivotal movement therebetween.

6. The ridge ventilation apparatus as defined in claim 5, wherein said pivot means comprises an outer tube having a slot extending therealong which is attached to the upper end of a first of said left and right half sections and an inner tube which is connected to a second of said left and right half sections, said inner tube being coaxially slidable within said outer tube.

7. The ridge ventilation apparatus as defined in claim 1, wherein said left and right lower frames are identical in structure and are connected to extend below the respective left and right half sections of said top frame as mirror images of one another.

8. The ridge ventilation apparatus as defined in claim 7, wherein the upper part of each of said lower frame includes a generally vertical hanger portion which extends downwardly from the respective half section and in which said exhaust opening is located, and an outwardly and downwardly inclined inner portion.

9. The ridge ventilation apparatus as defined in claim 8, wherein the lower part of each of said lower frame includes a generally vertical fixing portion which extends downwardly from the outwardly and downwardly inclined inner portion of said upper part, and an outwardly and downwardly inclined skirt portion, said connecting portion extending outwardly from said generally vertical fixing portion.

10. The ridge ventilation apparatus as defined in claim 9, wherein the connecting portion of each said lower frame is fixedly attached to the lower end of the respective half section located outwardly thereof.

11. The ridge ventilation apparatus as defined in claim 9, wherein the generally vertical fixing portions of the lower parts of said lower frames include holes therein.

12. The ridge ventilation apparatus as defined in claim 9, wherein each of said lower frames includes insulation on areas of the sides of the hanger, inner and fixing portions which are opposite the sides facing the respective chambers formed thereby.

13. The ridge ventilation apparatus as defined in claim 8, wherein each of said left and right half sections includes a hook extending downwardly from its lower surface at a point between its upper end and its downwardly extending baffle plate, and wherein the generally vertical portion of the upper part of each lower frame includes an upper end which is hook shaped so as to hang downwardly from the hook of the associated half section.

14. The ridge ventilation apparatus as defined in claim 1, wherein each of said half sections of said top frame include a plurality of exhaust ports, the exhaust ports in each of said half sections being aligned along the length of said top frame.

15. The ridge ventilation apparatus as defined in claim 1, including a single backboard located within said left and right lower frames near the elongated ends thereof and extending beyond said elongated ends thereof, said backboard preventing water penetration between two said ridge ventilation apparatus positioned together in end to end contact.

16. The ridge ventilation apparatus as defined in claim 1, wherein the top frame is dimensioned to fit within the end collar of an adjacent said ridge tile.

17. The ridge ventilation apparatus as defined in claim 1, wherein the lower sides of the exhaust ports in the left and right sections of said top frame are lower than the lower sides of the exhaust openings in the upper parts of the associted left and right lower frames.

* * * * *